United States Patent [19]

Miller

[11] 4,360,557

[45] Nov. 23, 1982

[54] PHOSPHORESCENT ABRASIVE COATED PRODUCT FOR SAFETY TREAD

[75] Inventor: James A. Miller, Stow, Ohio

[73] Assignee: Morgan Adhesives Company, Stow, Ohio

[21] Appl. No.: 212,639

[22] Filed: Dec. 3, 1980

[51] Int. Cl.[3] ..... B32B 5/02

[52] U.S. Cl. ..... 428/142; 428/144; 428/148; 428/354; 428/913; 428/910; 428/401; 428/403; 427/157; 250/462.1; 252/301.6 S

[58] Field of Search ..... 428/40, 142, 148, 149, 428/690, 913, 403, 144, 354, 910, 401; 427/157; 52/179, 181, 188; 250/462; 404/19, 20, 22; 252/301.6 S

[56] References Cited

U.S. PATENT DOCUMENTS 3,227,604 1/1966 Morgan ..... 404/20 X 3,884,505 5/1975 Miller ..... 282/27.5

4,058,942 11/1977 Naka ..... 52/179

*Primary Examiner*—Marion McCamish

*Assistant Examiner*—Alexander S. Thomas

*Attorney, Agent, or Firm*—Oldham, Oldham, Hudak & Weber Co.

[57] ABSTRACT

A phosphorescent safety tread made from a laminate including a backing layer, a layer of pressure sensitive adhesive on the backing layer, and a carrier film and which includes, on the surface of the carrier film, a layer of light-colored grit bonded to a face surface of the carrier film and a size coat applied over the grit and aiding in bonding the grit to the carrier film, which size coat includes phosphorescent pigment particles embedded therein for light storage and reflective action and use of the laminate as a phosphorescent safety tread or other similar purpose.

1 Claim, 2 Drawing Figures

PHOSPHORESCENT ABRASIVE COATED PRODUCT FOR SAFETY TREAD

BACKGROUND ART

Heretofore, there have been various types of phosphorescent paints made and these paints have used phosphorescent pigment powders or particles therein. The paints have various uses and can be applied to products where it is desired to store light energy therein for afterglow action when the lighting energy source is removed.

Nearly all commercial buildings have well marked exit signs provided therein to show the routes to follow under emergency conditions for moving from the building. However, under such emergency conditions, frequently, no lighting power will be available whereby these exit corridors or stairways, or the like can be quite dark.

DISCLOSURE OF INVENTION

The general object of the present invention is to provide an improved, novel type of a safety tread, particularly one having phosphorescent properties and which tread can have a coating of frictional grit thereon to aid in providing an effective stair tread construction.

Another object of the invention is to provide a new and improved laminate particularly adapted for use in emergency exit stairways and the like, and wherein the safety tread can be adhered in position by a self-contained adhesive layer and form an integral, but removable, floor tread member which may be provided with an abrasive surface to create good frictional contact with a person walking over the tread.

Another object of the invention is to provide a novel, improved laminate assembly involving a tough, durable carrier film, a layer of light-colored grit suitably bonded to the face surface of the carrier film, and a size coat applied over the grit to aid in holding it to the carrier film, and which size coat is made from a clear, colorless plastic adhesive material and wherein phosphorescent pigment particles are embedded in the size coat for an afterglow radiant energy release after the exciting light source has been removed.

The foregoing and other objects and advantages of the invention will be made more apparent as the specification proceeds.

In general, the phosphorescent safety tread and/or laminate of the invention comprises a backing layer with a layer of pressure sensitive adhesive thereon and a carrier film, and which laminate or product is characterized by a layer of grit bonded to a face surface of the carrier film and a size coat applied over the grit to help affix it to the carrier film, which size coat is made from a colorless plastic material and has phosphorescent pigment particles embedded therein whereby the laminate by such pigment particles will absorb light rays and release them after the energizing light source has been removed.

BRIEF DESCRIPTION OF DRAWINGS

Attention is now directed to the accompanying drawings, in which.

When referring to corresponding members shown in the drawings and referred to in the specification, corresponding numerals are used to facilitate comparison therebetween.

Figure 1:
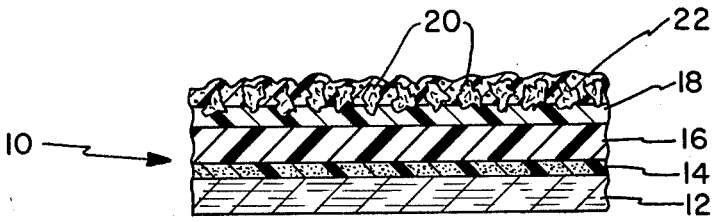
FIG. 1 shows an enlarged vertical cross-section of a phosphorescent safety tread laminate embodying the principles of the invention.
Figure 2:
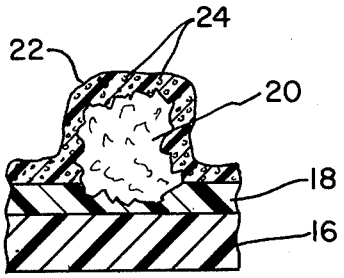
FIG. 2 is an enlarged section of the size coat layer in the laminate.

It should be understood that the particles and films in the novel laminate of the invention are shown in the drawing in exaggerated size and that the carrier film, backing film, adhesive layer, etc., can be quite thin, such as from about 0.001 or less to about 0.008 inch in thickness.

BEST MODE FOR CARRYING OUT THE INVENTION

Reference now is particularly directed to the details of the construction shown in the accompanying drawings, and a phosphorescent safety tread of the invention is shown and the laminate is indicated as a whole by the numeral 10. This laminate or tread is made from a release or backing layer 12 that usually is made from a fibrous paper material as is well known in the art and which paper can be separated from the remainder of the laminate when it is desired that the laminate be placed in use. The remaining portions of the laminate are secured in position by means of a pressure sensitive layer 14 that is used to affix the paper backing layer temporarily to the remainder of the laminate and which layer retains its adhesive properties for being attached to a desired support surface. The pressure sensitive layer is of any conventional composition such as are well known in the art.

The laminate of the invention preferably includes a relatively durable, tough, flexible sheet or film 16 that is adapted to mount an abrasive surface layer thereon. This carrier film 16 can be made from any suitable material such as a white polyvinyl chloride or white or light-colored polypropylene or even a white cloth but a two-ply flexible laminate layer made from a high density polyethylene is one very suitable material for use in making up this layer 16. Such polyethylene film is described in my prior U.S. Pat. No. 3,884,505. In this two-ply flexible laminate, each ply is oriented in one direction and the directions of orientation are not in alignment in the laminated layer. The layer or film 16 normally is white and it provides a very good base for the surface portion of the safety tread laminate.

In making up the laminate of the invention, a binder liquid coat is applied to the face surface of the carrier film 16 to form a binder layer 18, and such binder coating is made from any known binder material that can bind a grit particle to the film layer 16. A conventional polyvinyl chloride latex is one suitable binder material usable for this purpose. While this binder coat is still liquid, then a layer 20 of a grit is applied to the face surface of the carrier film. This grit can be applied electrostatically or by gravity to the binder layer on the carrier film, again all in a well known manner, after which the binder coat would be dried to secure the grit permanently to the carrier film.

To complete the laminate of the invention, and to aid in bonding the grip particles to the carrier film, I next apply a size coating 22 over the grit-covered surface of the face layer on the film. Thus, this size coating is applied in a liquid form and the size coat includes phosphorescent pigment particles 24 therein. Hence, when the size coat is dried, the size coat aids in bonding base portions of the grit particles to the face surface of the carrier film and the pigment particles are exposed on the surface of the laminate for absorbing radiant energy in the form of light rays falling thereon.

The size coat which contains the pigment therein normally comprises a two-part epoxy material of conventional composition, wherein the two parts are mixed together and will set up in several minutes so as to form a substantially transparent binder or cover coat on the face surface of the carrier film, and the pigment particles are mixed into the epoxy so as to be mixed therethrough and be retained therein as the size coat sets in position.

Any durable, clear or colorless resin system can be used for this size coat and materials such as polyurethane, polyester, curable acrylics, etc., are known materials that also can be used as the size coat. The binder material in the size coat includes dissolved solid coating resins and modifiers and, in the particular example of the safety tread made and referred to hereinabove, the phosphorescent pigment particles comprise 30 percent dry weight ratio of the pigment to coating solids, resins and modifiers, in the size coat. However, this ratio of pigment-to-binder solids can vary between a range of from about 10 to about 70 percent, and wherein, of course, the amount of afterglow obtained is dependent on the amount of phosphorescent pigment present in the laminate.

The amount of grit applied to form a product such as sandpaper-like material or the like can be varied so that the grit will cover the surface of the carrier film from about 50 percent to about 100 percent coverage of such layer. The grit preferably used in making our particular laminate is aluminum oxide grit with a mesh size of 80. This grit size can be made larger or smaller dependent upon the desired coefficient of friction.

Any white or light-colored grit could be used, examples of which are aluminum oxide, flint, or equivalent materials.

In making the laminate of the invention, the binder material used was applied at a dry weight of about 1.5 pounds per ream of laminated product. A ream of this laminate is considered to be 330 foot square of product. For example, it could be 480 sheets, 9 inch by 11 inch. But, the range of binder coating material used per ream could vary from about 0.5 to 5 pounds, dependent upon the strength of the binder coat desired and the ultimate end product.

In making the product of the invention, the actual size coating material, as used to cover the grit, was 5 pounds per ream of the laminated end product. However, a range of from about 2 pounds to about 10 pounds per ream of laminate end product is reasonable to provide desirable performance of the phosphorescent-coated safety tread end product. The more size coating, and the more pigment, the better the afterglow condition, as will be readily recognized.

The phosphorescent pigment used can be a material such as Phosphorescent 2330 supplied by the United States Radium Corporation of Morristown, N.J. Approximately 99 percent of these particles of such pigment will pass through a 200 mesh sieve. The pigment has a light green daylight color.

Other coating binder materials that could be used to secure the grit to the carrier layer could be polyvinylacetate-latex emulsions, or other similar products as desired.

The product of the invention should be capable of being rolled up upon itself and hence sufficient flexibility should be provided in the various layers in the laminate and the materials securing the grit in position, so as to withstand and favorably respond to some flexing of the laminate.

In the laminate of the invention, the size coat material applied to the grit-coated surface of the face material has a further function, and that is of filling up the surface of the laminate around the grit particles, whereby dirt particles do not get ground in or be pushed into the laminate as much as might otherwise occur.

The carrier film referred to hereinabove, made from high density polyethylene provides a very durable, flexible, reinforcing member in the laminate and aids in providing desirable operative properties in the end product. This product can be secured to floors, stairs, and other areas, wherein some fluorescent activity and action is desired under emergency darkened conditions. The laminate of the invention is not difficult or expensive to make, but it provides a durable, useful product for the purpose as stated.

In the drawing, components are not shown in accurate scale relationship.

While in accordance with the patent statutes, the best mode and preferred embodiment of the invention has been set forth, it is to be understood that the scope of the invention is measured by the appended claims.

What is claimed is:

1. A phosphorescent laminated safety tread, comprising:

a layer of pressure sensitive adhesive, and a white carrier film bonded on its back surface to one surface of said adhesive layer and which is characterized by said carrier film comprising a two ply layer of high density polyethylene, each ply being oriented in one direction and which directions are not in alignment in said carrier ply;

a layer of light-colored grit bonded to and protruding from a face surface of said carrier film;

a size coat that extends over and covers said grit, which size coat is made from a transparent flexible material, and phosphorescent pigment particles embedded in and distributed throughout said size coat;

where from about 10 percent to about 70 percent dry weight of pigment is present in relation to the solids content of said size coat, where said grit covers from about 50 percent to 100 percent of the surface of said carrier film, and where said grit is size 80, and where said pigment is phosphorescent and 99 percent of said pigment particles will pass through a 200 mesh sieve.

* * * * *